US008857049B2

(12) United States Patent
O'Sullivan et al.

(10) Patent No.: US 8,857,049 B2
(45) Date of Patent: Oct. 14, 2014

(54) APPARATUS AND METHODS FOR ENVIRONMENTALLY SEALING TERMINAL BLOCKS

(75) Inventors: Edward O'Sullivan, Cary, NC (US); George W. Pullium, III, Garner, NC (US); Mahmoud K. Seraj, Apex, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 55 days.

(21) Appl. No.: 13/614,419

(22) Filed: Sep. 13, 2012

(65) Prior Publication Data

US 2014/0073175 A1 Mar. 13, 2014

(51) Int. Cl.
*H01R 43/00* (2006.01)

(52) U.S. Cl.
USPC ..... 29/825; 29/592.1; 29/858; 29/856; 29/859; 29/866; 439/263; 439/271; 439/411; 439/417; 277/921; 277/924; 277/314; 174/74 A; 174/93; 174/102 R; 174/92; 174/77 R

(58) Field of Classification Search
USPC ..... 29/592.1, 825, 858, 856, 859, 862, 866; 439/263, 271, 411, 417; 277/921, 924, 277/314; 174/74 A, 93, 102 R, 92, 77 R
See application file for complete search history.

(56) References Cited

U.S. PATENT DOCUMENTS

| | | | | |
|---|---|---|---|---|
| 4,718,678 | A * | 1/1988 | Vansant | 277/312 |
| 4,741,709 | A * | 5/1988 | Jervis | 439/521 |
| 5,016,952 | A * | 5/1991 | Arroyo et al. | 385/95 |
| 6,848,949 | B2 | 2/2005 | Mullaney et al. | |
| 7,393,425 | B2 * | 7/2008 | Buekers et al. | 156/53 |
| 2011/0100671 | A1 * | 5/2011 | Seraj et al. | 174/68.1 |

OTHER PUBLICATIONS

"GelGuard Sealant Filled RJ Modular PC Mount Jacks and Plugs" © 2005-2008, Tyco Electronics, C266.04/09 (2 pages).

* cited by examiner

*Primary Examiner* — Peter DungBa Vo
*Assistant Examiner* — Azm Parvez
(74) *Attorney, Agent, or Firm* — Myers Bigel Sibley & Sajovec, P.A.

(57) ABSTRACT

A method for environmentally protecting a terminal block includes providing a sealing device including: a base substrate having an anchoring surface; and a gel sealant body having an engagement surface. The gel sealant body is secured to the anchoring surface and extends forwardly from the anchoring surface to the engagement surface. The method further includes: applying the sealing device to the terminal block such that the gel sealant body is interposed between the terminal block and the base substrate and the engagement surface engages the terminal block; and wrapping a retainer member around the terminal block and securing the sealing device to the terminal block using the retainer member.

19 Claims, 10 Drawing Sheets

APPARATUS AND METHODS FOR ENVIRONMENTALLY SEALING TERMINAL BLOCKS

FIELD OF THE INVENTION

The present invention relates to environmental protection of electrical connections and, more particularly, to methods and apparatus for environmentally sealing terminal blocks.

BACKGROUND OF THE INVENTION

Electrical connections between low voltage cables (e.g., telephone cables) are commonly made at terminal blocks, which may be subjected to moisture and other environmental contaminants even when mounted in a junction box. Moisture entering a junction box and collecting on the terminal block can cause corrosion and/or crosstalk along multiple connection points.

SUMMARY OF THE INVENTION

According to method embodiments of the present invention, a method for environmentally protecting a terminal block includes providing a sealing device including: a base substrate having an anchoring surface; and a gel sealant body having an engagement surface. The gel sealant body is secured to the anchoring surface and extends forwardly from the anchoring surface to the engagement surface. The method further includes: applying the sealing device to the terminal block such that the gel sealant body is interposed between the terminal block and the base substrate and the engagement surface engages the terminal block; and wrapping a retainer member around the terminal block and securing the sealing device to the terminal block using the retainer member.

According to embodiments of the present invention, an environmental sealing system kit for environmentally protecting a terminal block includes a sealing device and a retainer member. The sealing device includes: a base substrate having anchoring surface; and a gel sealant body having an engagement surface. The gel sealant body is secured to the anchoring surface and extends forwardly from the anchoring surface to the engagement surface. The sealing device is configured to be applied to the terminal block such that the gel sealant body is interposed between the terminal block and the base substrate and the engagement surface engages the terminal block. The retainer member is configured to be wrapped around the terminal block to secure the sealing device to the terminal block.

According to embodiments of the present invention, an environmentally protected terminal block assembly includes a terminal block, a sealing device and a retainer member. The sealing device includes: a base substrate having anchoring surface; and a gel sealant body having an engagement surface. The gel sealant body is secured to the anchoring surface and extends forwardly from the anchoring surface to the engagement surface. The sealing device is mounted on the terminal block such that the gel sealant body is interposed between the terminal block and the base substrate and the engagement surface engages the terminal block; and the retainer member is wrapped around the terminal block and secures the sealing device to the terminal block.

According to embodiments of the present invention, an environmental sealing system kit for environmentally protecting a terminal block includes a sealing device including: a base substrate having anchoring surface; and a gel sealant body having an engagement surface. The gel sealant body is secured to the anchoring surface and extends forwardly from the anchoring surface to the engagement surface. The base substrate is semi-rigid and bendable to conform the sealing device to the terminal block.

Further features, advantages and details of the present invention will be appreciated by those of ordinary skill in the art from a reading of the figures and the detailed description of the embodiments that follow, such description being merely illustrative of the present invention.

DETAILED DESCRIPTION OF EMBODIMENTS OF THE INVENTION

Figure 1:
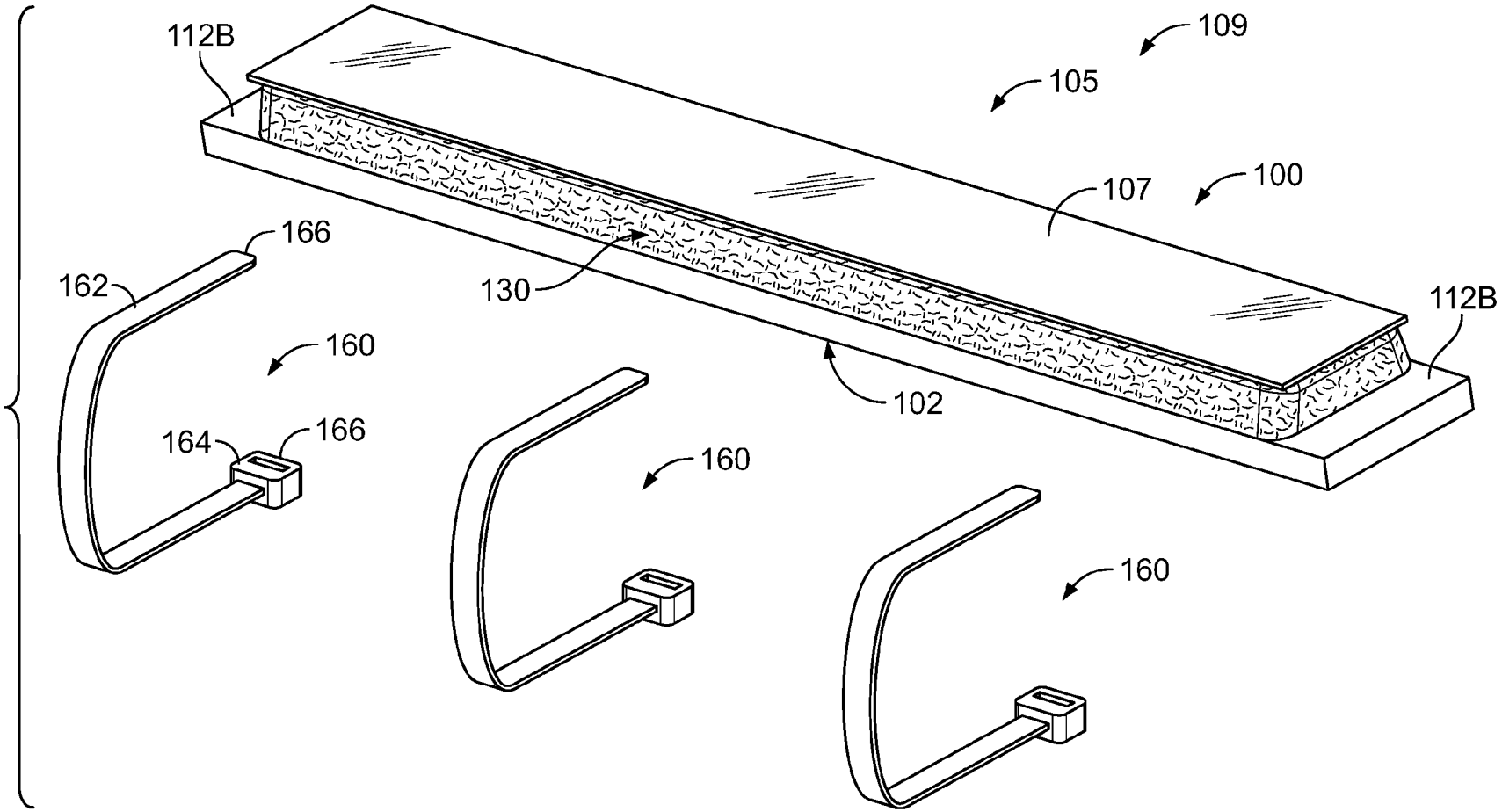
FIG. 1 is a perspective view of a terminal block environmental sealing system and kit according to embodiments of the present invention
Figure 2:
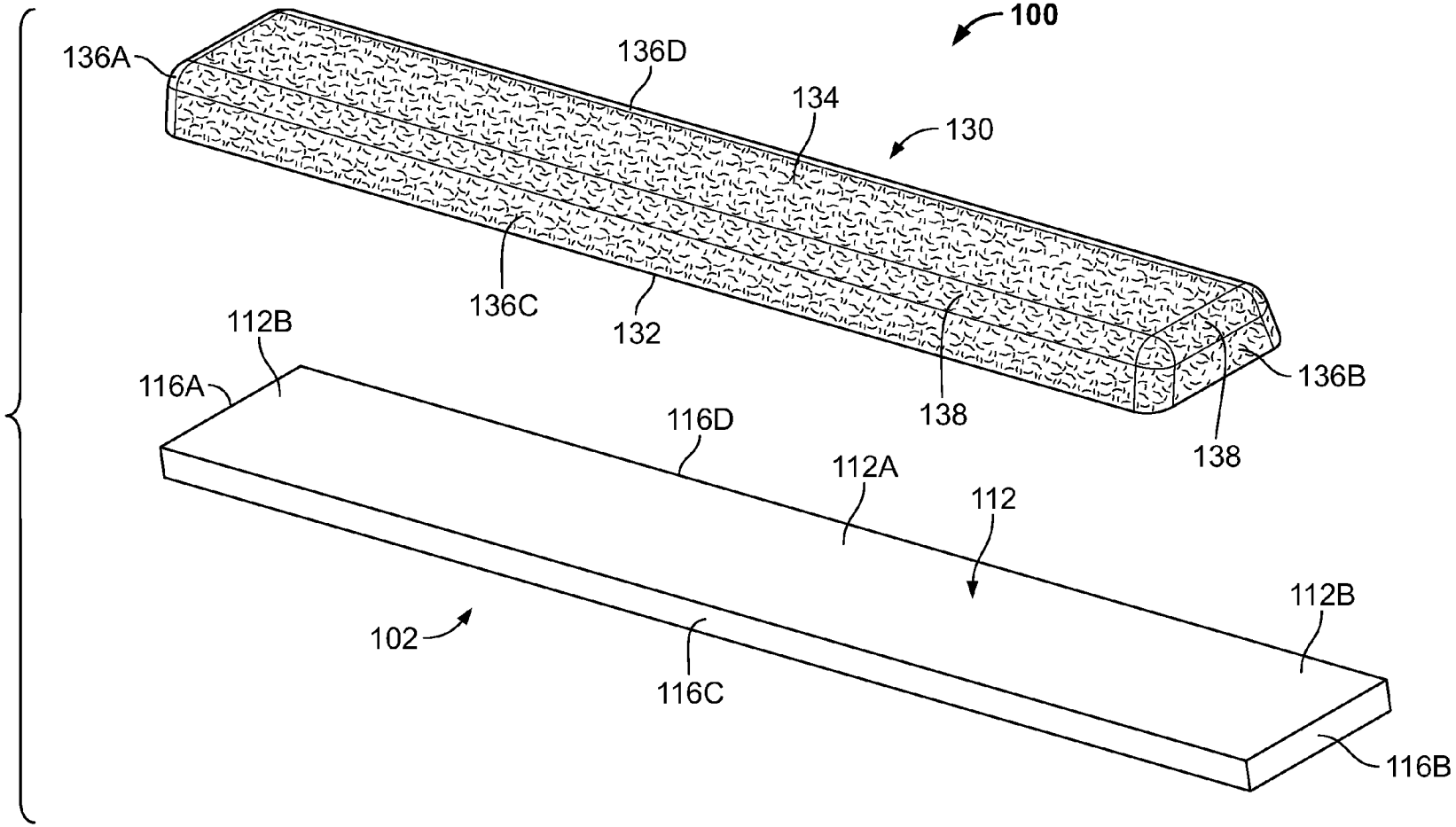
FIG. 2 is an exploded, top perspective view of a sealing device forming a part of the system of FIG. 1.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

With reference to FIGS. 1-10, an environmentally protected terminal block assembly 10 including an environmental sealing system 105 according to embodiments of the present invention is shown therein.

The environmentally protected terminal block assembly 10 includes a terminal block 20 mounted on a bracket 30 in a junction box 40. However, the environmental sealing system 105 may be used with other terminal block configurations, mounting techniques and locations. Low voltage cables 50 are terminated and electrically connected at terminals or connectors 24 on the terminal block 20 to form connections 55. According to some embodiments, the cables 50 carry signals having voltages in the range of from about 2 to 12 volts and, in some embodiments, from about 12 to 60 volts. In some embodiments, the cables 50 are telephone wires. The exemplary terminal block 20 has a top portion 22 (including the connectors 24 and the connections 55) and a base portion 26 through which fasteners 28 are inserted to secure the terminal block 20 to the bracket 30. The bracket 30 may include mount holes 32 through which fasteners 34 are inserted to secure the bracket 30 to the junction box 40.

The sealing system 105 includes a sealing device or terminal cover 100, retainer members 160, and, in some embodiments, a release liner 107. In some embodiments, the sealing device 100, the retainer members 160 and the release liner 107 are packaged as a kit 109 (FIG. 1).

The sealing device 100 includes a base substrate 102 and a mass, block or body of gel sealant 130. According to some embodiments, the base substrate 102 and the gel sealant body 130 are provided to the installer as a pre-combined, unitary structure.

Figure 3:
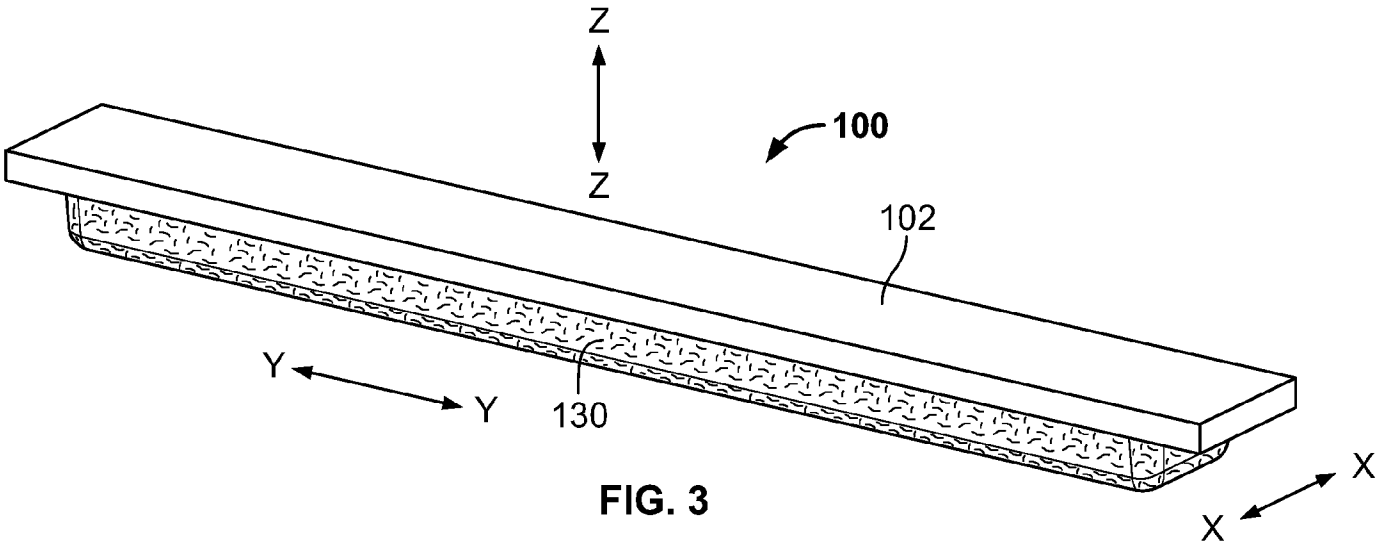
FIG. 3 is a bottom perspective view of the sealing device of FIG. 2.
Figure 4:
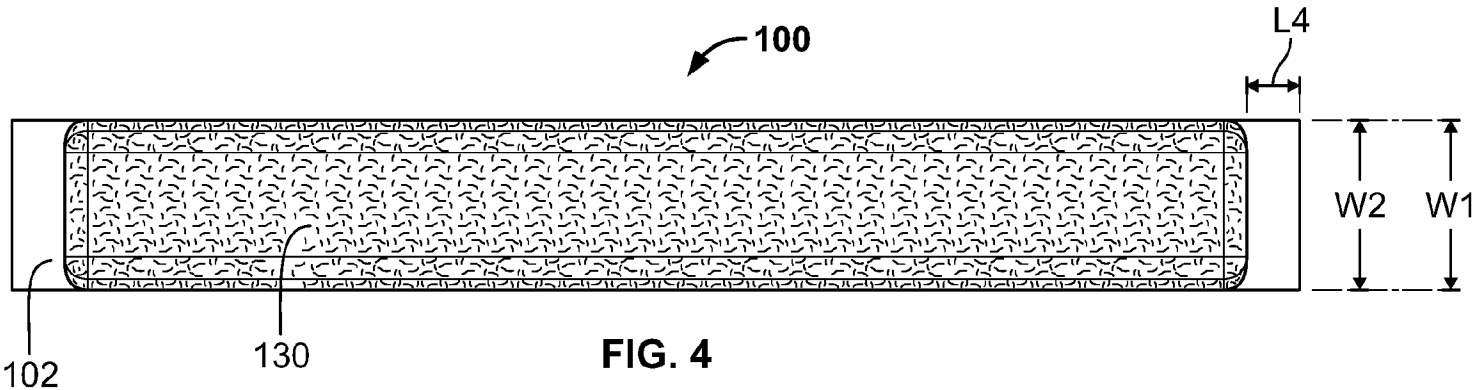
FIG. 4 is a top plan view of the sealing device of FIG. 2.
Figure 5:
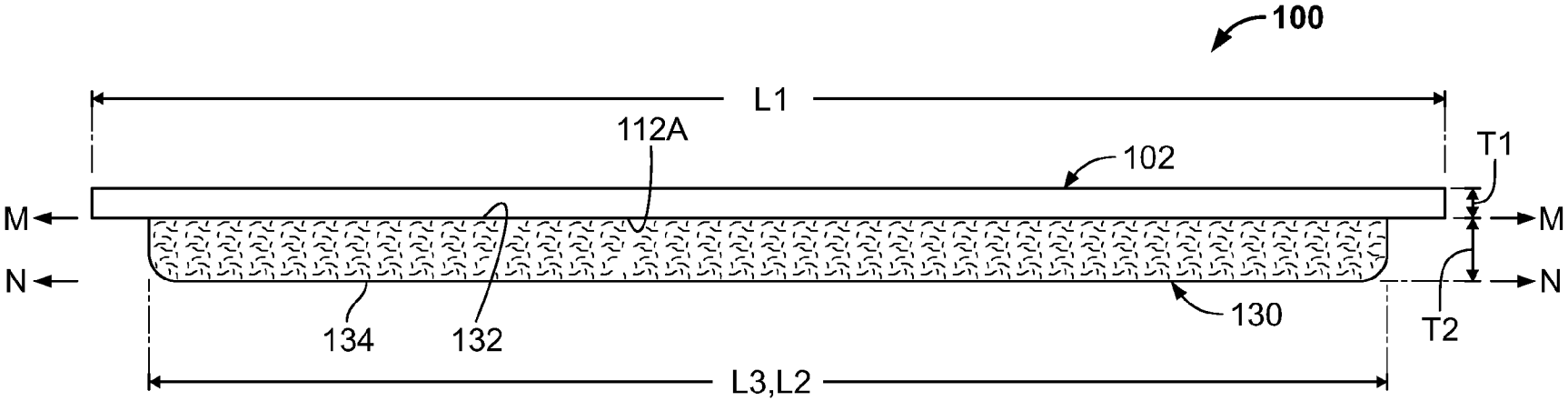
FIG. 5 is a side view of the sealing device of FIG. 2.
Figure 6:
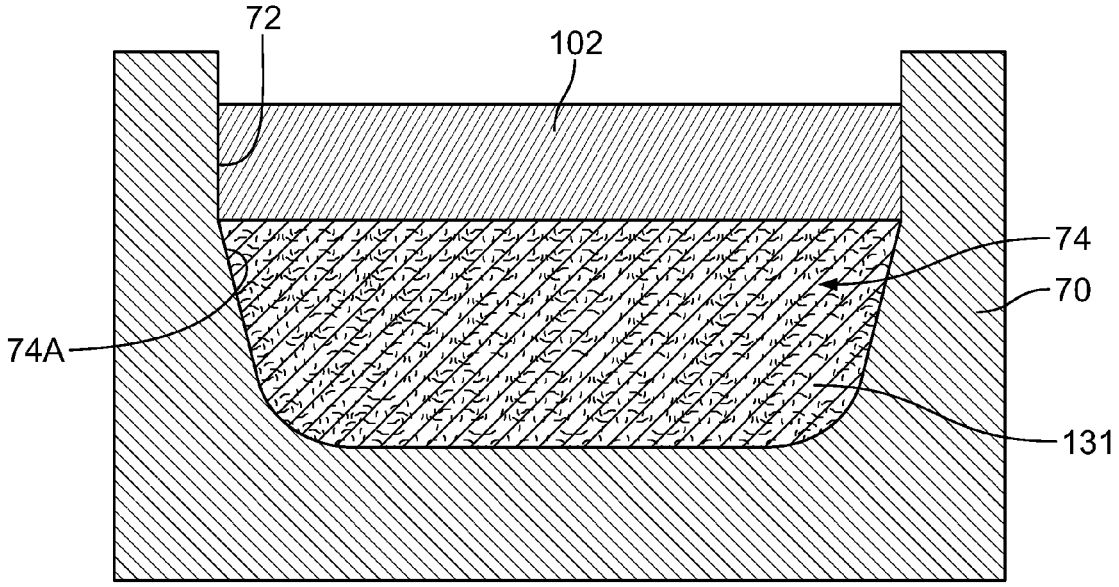
FIG. 6 is a cross-sectional end view of a mold for forming the sealing device of FIG. 2.

The base substrate 102 has a widthwise axis X-X, a lengthwise axis Y-Y and a heightwise axis Z-Z (FIG. 3). The base substrate 102 includes a substantially planar inner surface 112, and an opposing substantially planar outer surface 114 spaced apart along the heightwise axis Z-Z. The base substrate 102 further includes opposed end edges 116A and 116B and opposed side edges 116C and 116D. The inner surface 112 includes a gel anchoring section 112A and opposed holding tabs sections 112B adjacent the end edges 116A and 116B. The gel anchoring surface 112A defines a base plane M-M (FIG. 5)

The base substrate 102 is formed of a suitable material and, in some embodiments, is geometrically configured to be semi-rigid to permit the base substrate 102 to be bent or deflected at least lengthwise. In other embodiments, the base substrate is substantially rigid. According to some embodiments, the base substrate 102 is formed of a material having a Youngs Modulus in the range of from about 0.9 GPa to 2.0 GPa and, in some embodiments, from about 2.0 GPa to 3.0 GPa. According to some embodiments, the base substrate 102 is formed of a polymeric material. In some embodiments, the base substrate 102 is formed of polypropylene, ABS, or polycarbonate.

According to some embodiments, the thickness T1 (FIG. 5) of the base substrate 102 is in the range of from about 0.062 to 0.375 inch and, in some embodiments, from about 0.250 to 0.500 inch. According to some embodiments, the width W1 (FIG. 4) of the base substrate 102 is in the range of from about 0.500 to 0.750 inch and, in some embodiments, from about 0.750 to 2.000 inches. In some embodiments, the overall length L1 (FIG. 5) of the base substrate 102 is in the range of from about 7 to 11 inches and, in some embodiments, from about 9 to 17 inches. According to some embodiments, the length L3 (FIG. 5) of the gel anchoring section 112A is in the range of from about 6 to 10 inches and, in some embodiments, from about 8 to 16 inches. In some embodiments, each tab 112B has a length L4 (FIG. 4) in the range of from about 0.250 to 1.000 inch.

The gel sealant body 130 has a base surface 132 and an opposing engagement surface 134. The base surface 132 is bonded directly to the gel anchoring section 112A. In some embodiments, the gel anchoring section 112A of the surface 112 is textured to promote adhesion between the base surface 132 and the section 112A. In alternative embodiments, an intervening layer or component can be provided between the gel base surface 132 and the anchoring section 112A to secure the gel sealant body 130 to the base substrate 102.

The engagement surface 134 defines a gel sealant engagement plane N-N (FIG. 5) spaced apart from the base plane M-M and, in some embodiments, substantially parallel to the plane M-M. Opposed end wall surfaces 136A and 136B and opposed side wall surfaces 136C and 136D extend between the surfaces 132 and 134. Thus, it can be seen that the gel sealant body 130 constitutes a free standing, monolithic structure or body that is unconstrained on each of its engagement surface 134 and side and end surfaces 136A-D. The release liner 107 may be temporarily disposed on the engagement surface 134 to protect the gel sealant block 130 and for ease in handling. The gel sealant block 130 may have any desired geometric shape. In some embodiments, the gel sealant body 130 has rounded corners 138.

According to some embodiments, the gel sealant body 130 has a height or thickness T2 (FIG. 5) in the range of from about 0.125 to 0.500 inch and, in some embodiments, from about 0.375 to 0.750 inch. According to some embodiments, the gel sealant body 130 has a width W2 (FIG. 4) in the range of from about 0.500 to 1.000 inch and, in some embodiments, from about 0.750 to 2.0 inches. In some embodiments, the gel sealant body 130 has a length L2 (FIG. 5) in the range of from about 6 to 10 inches and, in some embodiments, from about 8 to 16 inches.

The gel sealant 130 may be any suitable gel sealant. As used herein, "gel" refers to the category of materials which are solids extended by a fluid extender. The gel may be a substantially dilute system that exhibits no steady state flow.

As discussed in Ferry, "Viscoelastic Properties of Polymers," 3rd ed. P. 529 (J. Wiley & Sons, New York 1980), a polymer gel may be a cross-linked solution whether linked by chemical bonds or crystallites or some other kind of junction. The absence of the steady state flow may be considered to be the definition of the solid-like properties while the substantial dilution may be necessary to give the relatively low modulus of gels. The solid nature may be achieved by a continuous network structure formed in the material generally through crosslinking the polymer chains through some kind of junction or the creation of domains of associated substituents of various branch chains of the polymer. The crosslinking can be either physical or chemical as long as the crosslink sites may be sustained at the use conditions of the gel.

Gels for use in this invention may be silicone (organopolysiloxane) gels, such as the fluid-extended systems taught in U.S. Pat. No. 4,634,207 to Debbaut (hereinafter "Debbaut '207"); U.S. Pat. No. 4,680,233 to Camin et al.; U.S. Pat. No. 4,777,063 to Dubrow et al.; and U.S. Pat. No. 5,079,300 to Dubrow et al. (hereinafter "Dubrow '300"), the disclosures of each of which are hereby incorporated herein by reference. These fluid-extended silicone gels may be created with non-reactive fluid extenders as in the previously recited patents or with an excess of a reactive liquid, e.g., a vinyl-rich silicone fluid, such that it acts like an extender, as exemplified by the Sylgard® 527 product commercially available from Dow-Corning of Midland, Mich. or as disclosed in U.S. Pat. No. 3,020,260 to Nelson. Because curing is generally involved in the preparation of these gels, they are sometimes referred to as thermosetting gels. The gel may be a silicone gel produced from a mixture of divinyl terminated polydimethylsiloxane, tetrakis (dimethylsiloxy)silane, a platinum divinyltetramethyldisiloxane complex, commercially available from United Chemical Technologies, Inc. of Bristol, Pa., polydimethylsiloxane, and 1,3,5,7-tetravinyltetra-methylcyclotetrasiloxane (reaction inhibitor for providing adequate pot life).

Other types of gels may be used, for example, polyurethane gels as taught in the aforementioned Debbaut '261 and U.S. Pat. No. 5,140,476 to Debbaut (hereinafter "Debbaut '476") and gels based on styrene-ethylene butylenestyrene (SEBS) or styrene-ethylene propylene-styrene (SEPS) extended with an extender oil of naphthenic or nonaromatic or low aramatic content hydrocarbon oil, as described in U.S. Pat. No. 4,369,284 to Chen; U.S. Pat. No. 4,716,183 to Gamarra et al.; and U.S. Pat. No. 4,942,270 to Gamarra. The SEBS and SEPS gels comprise glassy styrenic microphases interconnected by a fluid-extended elastomeric phase. The microphase-separated styrenic domains serve as the junction points in the systems. The SEBS and SEPS gels are examples of thermoplastic systems.

Another class of gels which may be used are EPDM rubber-based gels, as described in U.S. Pat. No. 5,177,143 to Chang et al.

Yet another class of gels which may be used are based on anhydride-containing polymers, as disclosed in WO 96/23007. These gels reportedly have good thermal resistance.

The gel may include a variety of additives, including stabilizers and antioxidants such as hindered phenols (e.g., Irganox™ 1076, commercially available from Ciba-Geigy Corp. of Tarrytown, N.Y.), phosphites (e.g., Irgafos™ 168, commercially available from Ciba-Geigy Corp. of Tarrytown, N.Y.), metal deactivators (e.g., Irganox™ D1024 from Ciba-Geigy Corp. of Tarrytown, N.Y.), and sulfides (e.g., Cyanox LTDP, commercially available from American Cyanamid Co. of Wayne, N.J.), light stabilizers (e.g., Cyasorb UV-531, commercially available from American Cyanamid Co. of Wayne, N.J.), and flame retardants such as halogenated paraffins (e.g., Bromoklor 50, commercially available from Ferro Corp. of Hammond, Ind.) and/or phosphorous containing organic compounds (e.g., Fyrol PCF and Phosflex 390, both commercially available from Akzo Nobel Chemicals Inc. of Dobbs Ferry, N.Y.) and acid scavengers (e.g., DHT-4A, commercially available from Kyowa Chemical Industry Co. Ltd through Mitsui & Co. of Cleveland, Ohio, and hydrotalcite). Other suitable additives include colorants, biocides, tackifiers and the like described in "Additives for Plastics, Edition 1" published by D.A.T.A., Inc. and The International Plastics Selector, Inc., San Diego, Calif.

The hardness, stress relaxation, and tack may be measured using a Texture Technologies Texture Analyzer or like machine, having a load cell to measure force, a 5 gram trigger, and ¼ inch (6.35 mm) stainless steel probe. For measuring the hardness, for example, of a 20 mL glass vial containing 12 grams of gel, the probe is forced into the gel at the speed of 0.2 mm/sec to a penetration distance of 4.0 mm. The hardness of the gel is the force in grams required to force the probe at that speed to penetrate the gel specified for 4.0 mm. Higher numbers signify harder gels.

The tack and stress relaxation are read from the stress curve generated by tracing the force versus time curve experienced by the load cell when the penetration speed is 2.0 mm/second and the probe is forced into the gel a penetration distance of about 4.0 mm. The probe is held at 4.0 mm penetration for 1 minute and withdrawn at a speed of 2.00 mm/second. The stress relaxation is the ratio of the initial force ($F_i$) resisting the probe at the pre-set penetration depth minus the force resisting the probe ($F_f$) after 1 min divided by the initial force $F_i$, expressed as a percentage. That is, percent stress relaxation is equal to $$\frac{(F_i - F_f)}{F_i} \times 100\%. \quad 1$$

where $F_i$ and $F_f$ are in grams. In other words, the stress relaxation is the ratio of the initial force minus the force after 1 minute over the initial force. It may be considered to be a measure of the ability of the gel to relax any induced compression placed on the gel. The tack may be considered to be the amount of force in grams resistance on the probe as it is pulled out of the gel when the probe is withdrawn at a speed of 2.0 mm/second from the preset penetration depth.

An alternative way to characterize the gels is by cone penetration parameters according to ASTM D-217 as proposed in Debbaut '261; Debbaut '207; Debbaut '746; and U.S. Pat. No. 5,357,057 to Debbaut et al., each of which is incorporated herein by reference in its entirety. Cone penetration ("CP") values may range from about 70 ($10^{-1}$ mm) to about 400 ($10^{-1}$ mm). Harder gels may generally have CP values from about 70 ($10^{-1}$ mm) to about 70 ($10^{-1}$ mm). Softer gels may generally have CP values from about 200 ($10^{-1}$ mm) to about 400 ($10^{-1}$ mm), with particularly preferred range of from about 250 ($10^{-1}$ mm) to about 375 ($10^{-1}$ mm). For a particular materials system, a relationship between CP and Voland gram hardness can be developed as proposed in U.S. Pat. No. 4,852,646 to Dittmer et al.

According to some embodiments, the gel has a Voland hardness, as measured by a texture analyzer, of between about 5 and 100 grams force. The gel may have an elongation, as measured by ASTM D-638, of at least 55%. According to some embodiments, the elongation is of at least 100%. The gel may have a stress relaxation of less than 80%. The gel may have a tack greater than about 1 gram.

Figure 9:
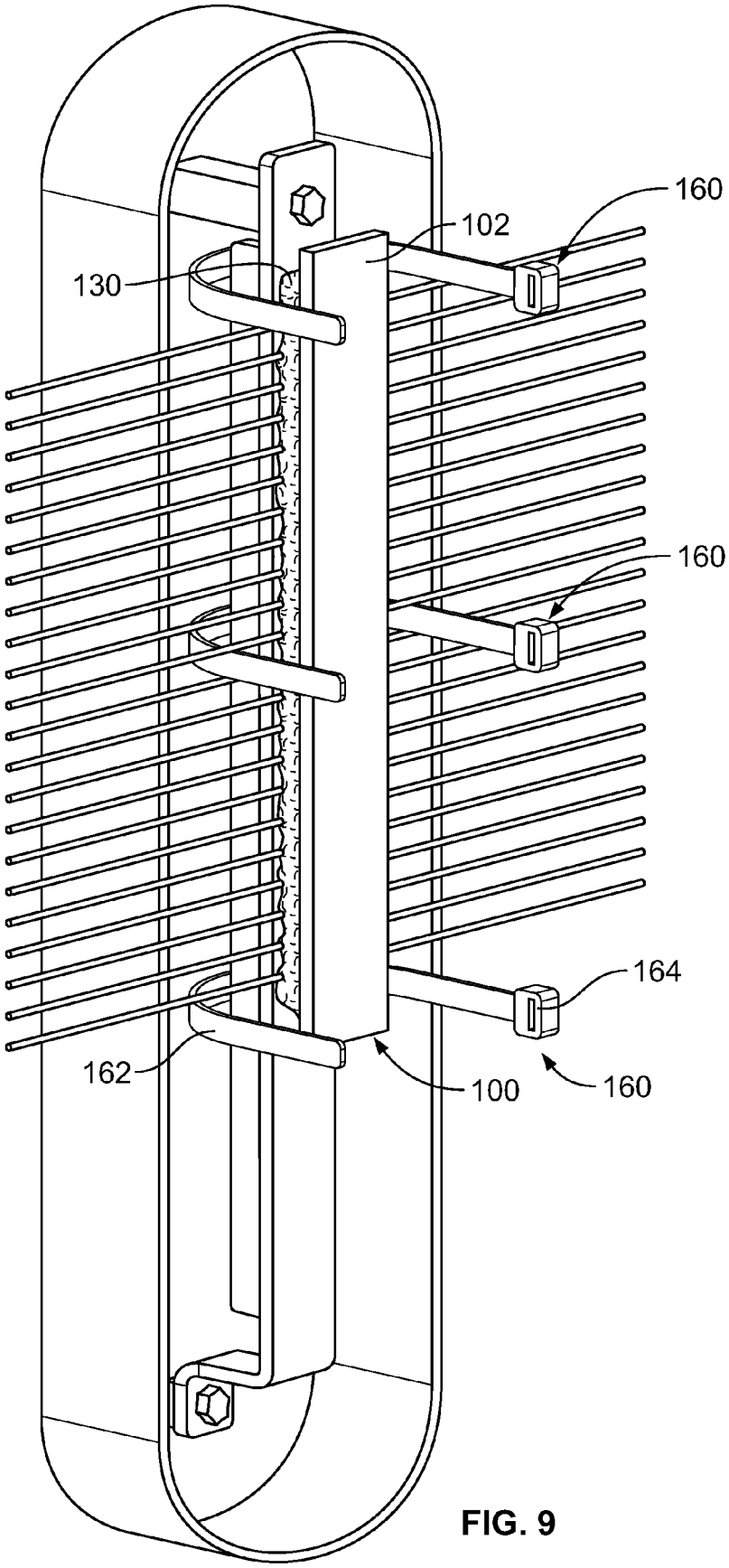

Each retainer member 160 includes a flexible strip or band 162 having opposed free ends 166 and a coupling or length adjustment mechanism 164 on one free end 166. According to some embodiments, each retainer member 160 can be initially configured as an open strip or loop (as shown in FIGS. 1 and 9) and thereafter reconfigured as an endless band. In some embodiments, the retainer members 160 are tie wraps. However, other types of adjustable bands may be used, such as hose clamps, clips or elastic bands, for example.

The sealing device 100 can be formed in the following manner according to embodiments of the present invention. The base substrate 102 is placed in or on a mold 70 having a substrate holder 72 and a gel cavity 74. The gel cavity 74 is filled with uncured liquid gel sealant material 131 until the material 131 engages the anchor surface 112A of the base substrate 102. The uncured sealant 131 is cured in situ to form the gel sealant body 130, which is thereby bonded directly to the anchoring surface 112A. The sealing device 100 can be insert-molded in this manner. To facilitate removal of the gel sealant body 130 from the mold 70, a release agent or mold surface coating may be applied to the inner surfaces 74A of the mold 70 and/or portions of the mold 70 may be cut or broken away from the gel sealant body 130.

In alternative embodiments, the gel sealant is extruded or dispensed onto the anchoring surface 112A with or without the aid of a mold.

Figure 10:
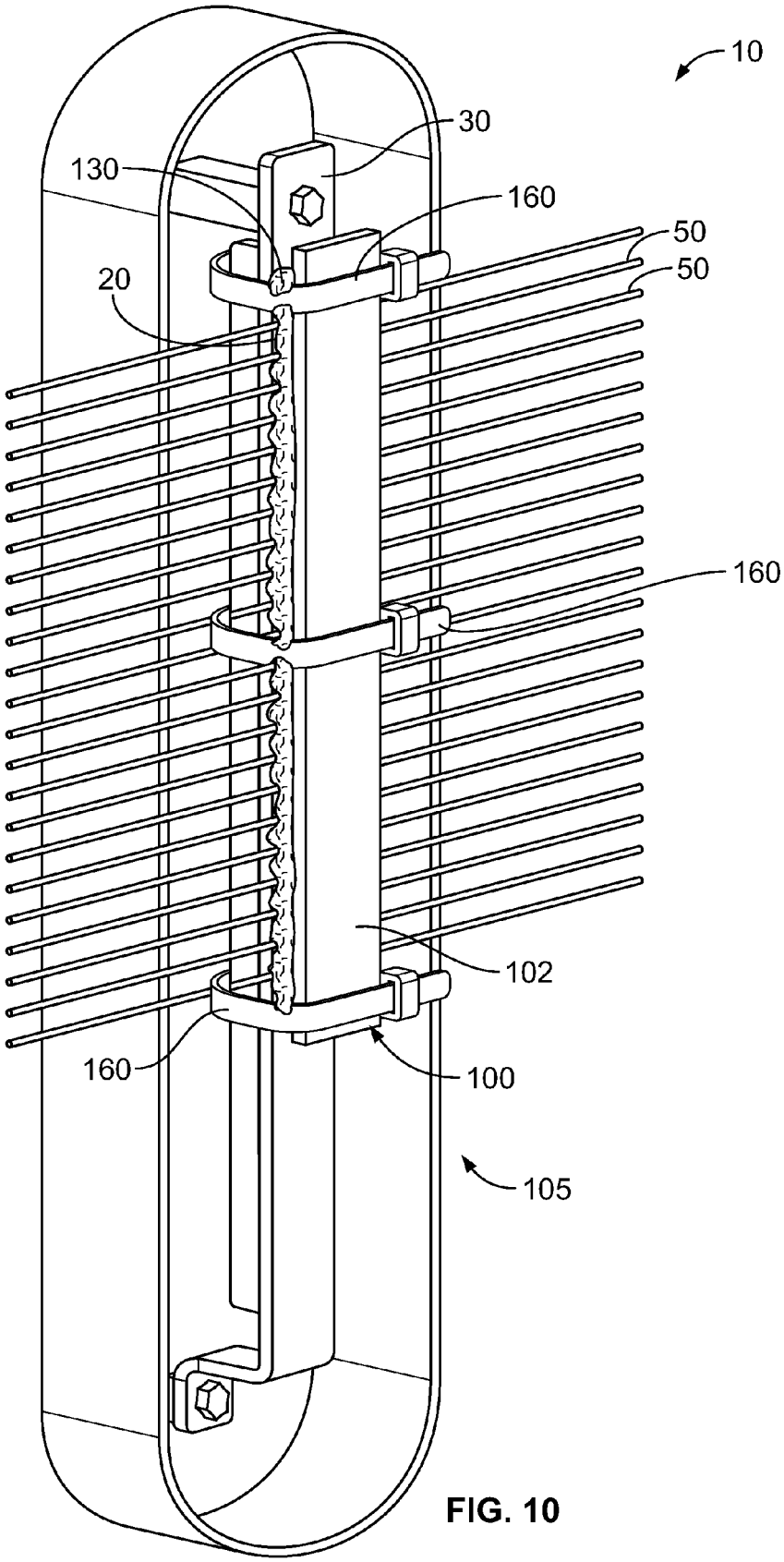

The environmental sealing system 105 can be installed on the terminal block 20 as follows in accordance with embodiments of the invention to form the environmentally protected terminal block assembly 10 (FIG. 10).

The release liner 107, if present is removed from the gel sealant body 130.

Figure 7:
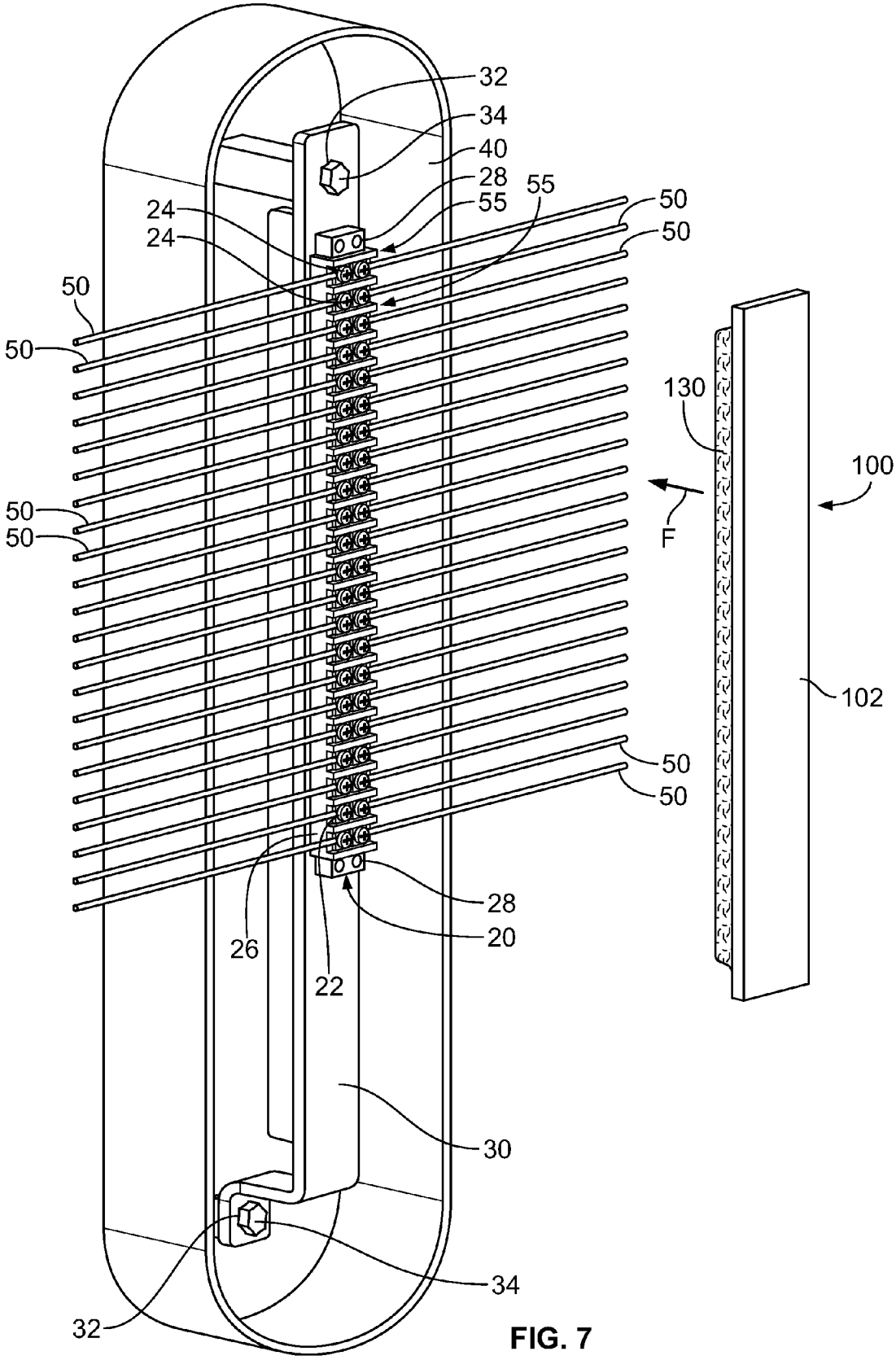
FIGS. 7-10 illustrate steps of a method according to embodiments of the present invention for forming an environmentally protected terminal block assembly using the system of FIG. 1.
Figure 8:
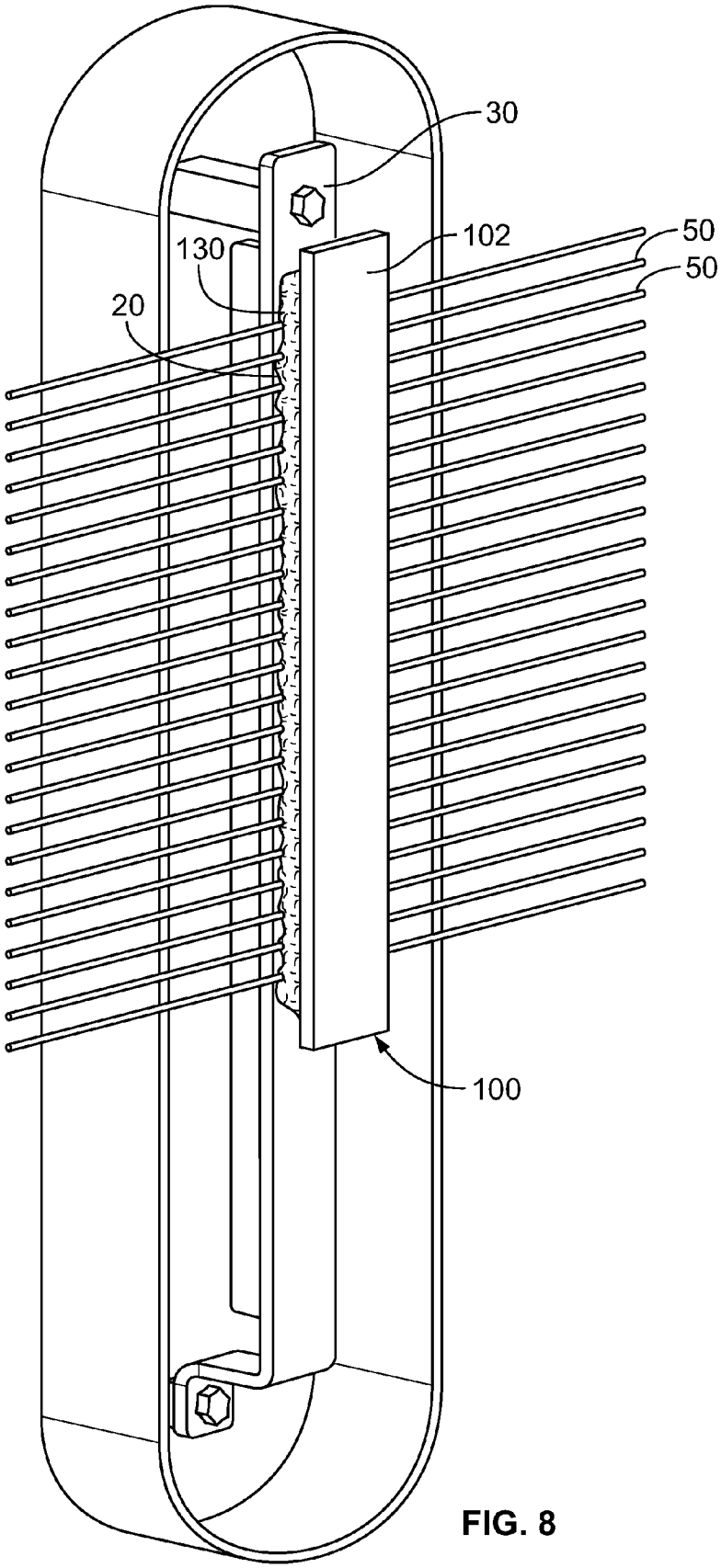

With reference to FIG. 7, the sealing device 100 is aligned with the terminal block 20 with the engagement surface 134 facing the top portion 22 and the connectors 24. The sealing device 100 is then forced onto the terminal block 20 in a direction F (FIG. 7) so that the gel sealant body 130 is pressed into the top portion 22 of the terminal block 20. More particularly, the gel sealant body 130 will flow into and about the connections 55 as shown in FIG. 8. In some embodiments, the sealing device 100 is temporarily held in place on the terminal block 20 by the gel sealant 130 as shown in FIG. 8. The gel sealant 130 may adhere to the terminal block 20.

The retainer members 160 (in their open configuration) are routed or wrapped around the terminal block 20 (e.g., around the bracket 30) as shown in FIG. 9 adjacent the ends and mid-span of the base substrate 102. The free ends 166 of each retainer 160 are coupled by its adjustment mechanism 164 to form a closed, 360 degree loop or band. According to some embodiments and as illustrated, each retainer 160 is wrapped fully around the terminal block 20 and, according to some embodiments, fully around each of the terminal block 20 and the sealing device 100.

These retainer members 160 are tightened or cinched tightly (e.g., by hand) about the sealing device 100 as shown in FIG. 10 to displace or compress (or further displace or compress) the gel sealant body 130. According to some embodiments, the retainer members 160 are tightened such that the gel sealant body 130 bulges sidewardly outwardly to surround and cover each connector 24 and is squeezed or displaced into the terminal block 20 and between the cables 50. The semi-rigid base substrate 102 can bend or deflect as needed to more closely match the contours of the terminal block 20.

According to some embodiments, with the sealing system 105 thus installed, the gel sealant 130 is elastically elongated or deformed so that the gel sealant 130 substantially conforms to the outer surfaces of the terminal block 20 and the cables 50. The restoring force in the gel sealant 130 resulting from this elastic deformation generally causes the gel to operate as a spring exerting a persistent outward force on the terminal block 20, the cables 50, the base substrate 102 and the retainer members 160. The compressive loading force and the restoring force are maintained by the retainer members 160.

Various properties of the gel as described above may ensure that the gel sealant 130 maintains a reliable and long lasting seal about the connectors 24 and the cables 50. The elastic memory of and the retained or restoring force in the elongated, elastically deformed gel generally cause the gel to bear against the mating surfaces of the connectors 24, and the conductors 50. Also, the tack of the gel may provide adhesion between the gel and these surfaces. The gel, even though it is cold-applied, is generally able to flow about the connectors 24 and the conductors 50 to accommodate their irregular geometries.

According to some embodiments, the sealant 130 is a self-healing or self-amalgamating gel. This characteristic, combined with the aforementioned compressive force may allow the sealant 130 to re-form into a continuous body if the gel is sheared during installation. The gel may also re-form if the sealing device 100 is removed from the terminal block 20.

The sealant 130, particularly when formed of a gel as described herein, may provide a reliable moisture barrier for the conductors 50 and the connectors 24, even when the assembly 10 is subjected to extreme temperatures and temperature changes.

The gel sealant 130 may also serve to prevent or inhibit corrosion of the connections by depositing a layer of oil from the gel on the exposed surfaces of the connectors 24 and conductor portions 50 on the terminal block 20. Even if the gel is removed from the connection, the oil may remain to coat the connection surfaces as a barrier to moisture.

The sealing device 100 provides a significant volume of exposed gel sealant 130 suspended from the surface 112 of the base substrate 102. According to some embodiments, the gel sealant body 130 has a volume of at least 1.75 $in^3$ and, in some embodiments, from about 2.25 $in^3$ to 5 $in^3$.

According to some embodiments and as shown in FIG. 1, there are no restraining side walls and the gel sealant body 130 is only restrained by the base wall 112. The unrestrained gel sealant 130 holds its shape in the absence of surrounding retaining walls. Therefore, the gel block or body 130 can be made with significant thickness and a range of hardnesses while retaining its shape. Because the gel sealant body 130 is suspended above the substrate surface 112 and thereby only restrained by one surface, the gel volume provides an unrestricted seal across and around the terminal contacts of the terminal block 20. The gel sealant body 130 surrounds each connector or terminal 24 and seals across the top of the terminal block 20 as well as between each contact terminal wire 50.

The sealing device 100 (including the gel sealant body 130) can be removed from the terminal block 20 without requiring removal of the terminal block 20 itself from the junction box 40 or removing any cables 50. The sealing system 105 can thereby serve as a "drop-in" sealing solution for a terminal block mounted in a junction box or the like.

Figure 11:
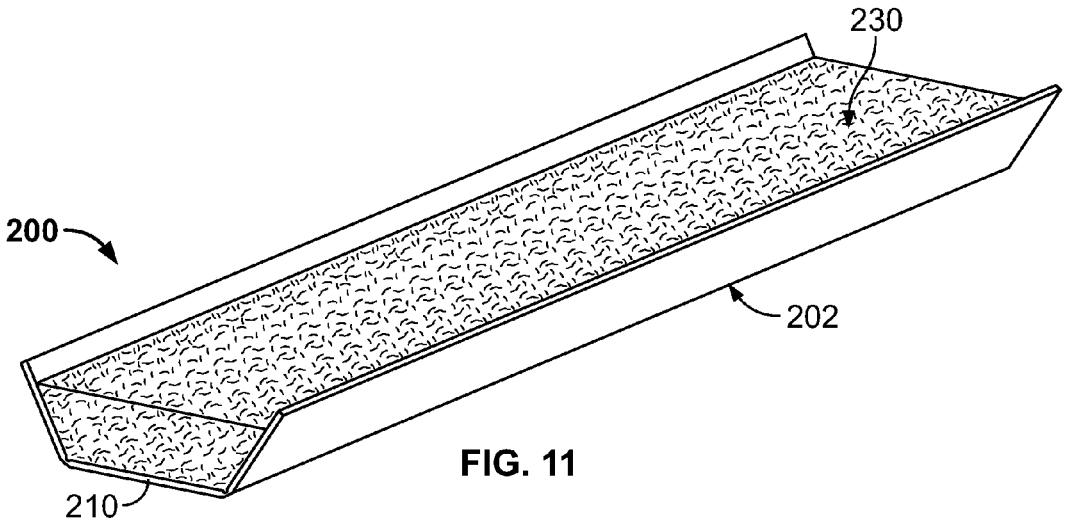
FIG. 11 is a top perspective view of a sealing device according to further embodiments of the present invention.
Figure 12:
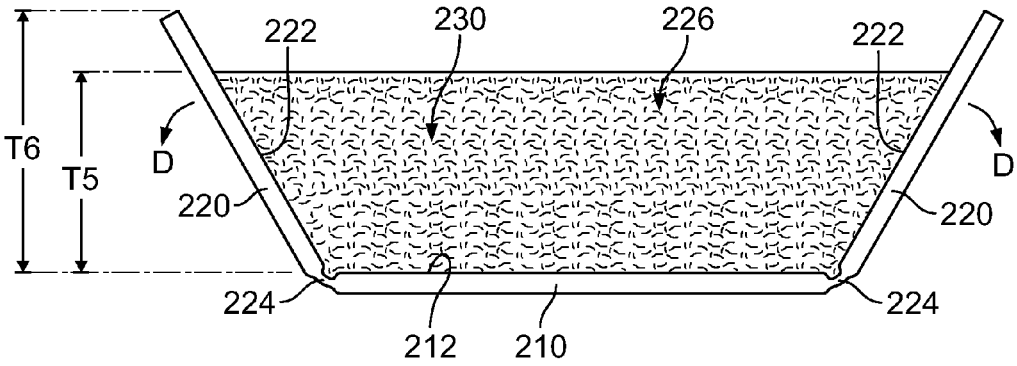
FIG. 12 is an end view of the sealing device of FIG. 11.
Figure 13:
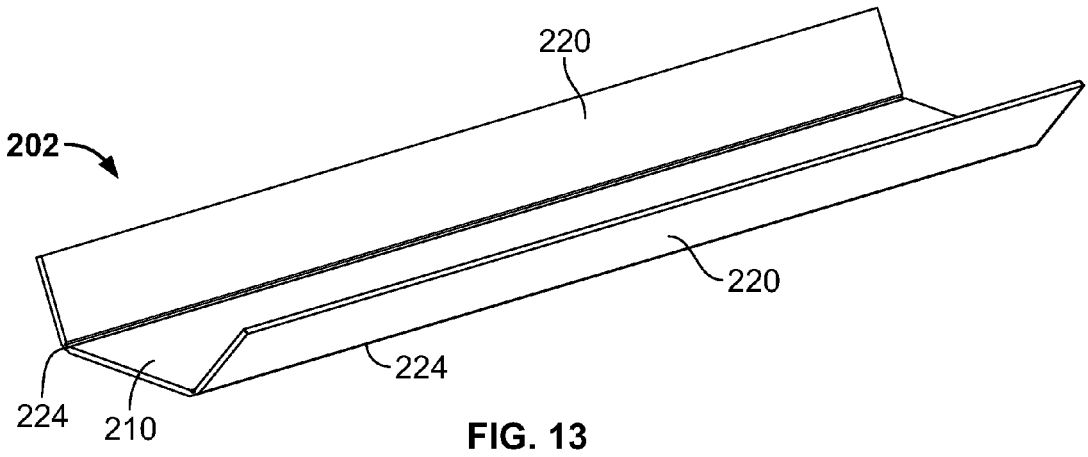
FIG. 13 is a top perspective view of a base substrate forming a part of the sealing device of FIG. 11.

With reference to FIGS. 11-13, a sealing device or cover 200 according to further embodiments of the invention is shown therein. The sealing device 200 can be used as described herein in place of the sealing device 100. The sealing device 200 includes a base substrate 202 and a gel sealant body 230 corresponding to the gel sealant body 130.

The base substrate 202 includes a base wall 210 (corresponding to the base wall 110) and a pair of opposed, longitudinally extending side walls 220 coupled to the side edges of the base wall 210 by living hinges 224. The walls 210, 220 define a cavity 226. The gel sealant body 230 is disposed in the cavity 226 and engages and adheres to the inner surface 212 of the base wall 210 and opposed inner surfaces 222 of the side walls 220. According to some embodiments, the height T5 (FIG. 12) of the gel sealant body 230 is in the range of from about 75 to 100 percent of the height T6 of the cavity 226.

In use, the sealing device 200 is installed on the terminal block 20 in the same manner as described above for the sealing device 100 using the retainer members 160. The flexible side walls 222 can deflect outwardly out of the way in divergent directions D (FIG. 12) to aid in installation. According to some embodiments, the flexible side walls 220 are able to bend or deflect lengthwise and permit the base wall to tend to bend or deflect lengthwise.

The sealing device 200 can be manufactured in the same manner as the sealing device 100. Alternatively, in some embodiments the ends of the cavity 226 are taped closed, the cavity 226 is filled with liquid uncured gel sealant, the gel sealant is cured in the cavity 226, and the tape is thereafter removed.

According to further embodiments, the side walls 220 may be rigidly connected to the base wall 210 (i.e., without hinges). In some embodiments, the side walls 220 extend beyond the engagement surface of the gel sealant body or vice versa. In some embodiments, the side walls may act to partially restrain or constrain the gel sealant.

As discussed above, retainer devices or mechanisms other than tie wraps may be used in some embodiments. For example, where the terminal block is mounted to a flat junction box, it may not be possible or convenient to wrap a tie wrap around the terminal block. In some embodiments, the retainer members may include clips or devices that clip onto the terminal block, or fasteners (e.g., screws forming a part of the terminal block assembly or additional screws) to hold the base substrate to the terminal block.

Embodiments of the present invention have been described above and, although specific terms are employed, they are used in a generic and descriptive sense only and not for purposes of limitation. The following claim is provided to ensure that the present application meets all statutory requirements as a priority application in all jurisdictions and shall not be construed as setting forth the scope of the present invention.

That which is claimed is:

1. A method for environmentally protecting a terminal block, the terminal block including multiple integral connectors interconnecting multiple electrical cables on a front side of the terminal block, the method comprising:

providing a sealing device including:

a base substrate having an anchoring surface; and a gel sealant body having an engagement surface, wherein the gel sealant body is secured to the anchoring surface and extends forwardly from the anchoring surface to the engagement surface;

applying the sealing device to the front side of the terminal block such that the gel sealant body is interposed between the terminal block and the base substrate and the engagement surface engages the connectors of the terminal block; and wrapping a retainer member around the terminal block and securing the sealing device to the terminal block using the retainer member;

wherein:

the engagement surface of the gel sealant body is located fully beyond the base substrate such that side and end faces of the gel sealant body are substantially unconstrained;

the base substrate is a substantially flat plate having no upstanding side walls;

the base substrate is semi-rigid and has a Young's Modulus in the range of from about 2.0 GPa to 3.0 GPa; and the method includes bending the base substrate to conform the sealing device to the terminal block.

2. The method of claim 1 wherein the retainer member includes a flexible elongate strip, and the method includes wrapping the elongate strip around the terminal block.

3. The method of claim 2 including wrapping the elongate strip around the base substrate also.

4. The method of claim 3 wherein the retainer member includes an adjustment mechanism operable to reduce an effective length of the elongate strip, and the method includes operating the adjustment mechanism to tighten the elongate strip about the terminal block and the base substrate to thereby load the gel sealant body against the terminal block.

5. The method of claim 4 wherein the retainer member is a tie wrap.

6. The method of claim 1 including wrapping a plurality of retainer members around the terminal block and the base substrate at spaced apart locations and thereby securing the sealing device to the terminal block using the plurality of retainer members.

7. The method of claim 1 wherein the gel sealant body is directly bonded to the anchoring surface of the base substrate.

8. The method of claim 1 wherein securing the sealing device to the terminal block includes elastically elongating the gel sealant body and, using the retainer member, maintaining the gel sealant body in an elastically elongated state so that the gel sealant body applies a persistent load to the terminal block and the base substrate.

9. The method of claim 1 wherein the cables are telephone wires.

10. The method of claim 1 wherein the gel sealant body is applied only to the front side of the terminal block so that, in the completed installation, a rear side of the terminal block opposite the front side of the terminal block remains free of gel sealant.

11. The method of claim 1 including a step of removing a release liner from the engagement surface of the gel sealant body prior to the step of applying the sealing device to the front side of the terminal block.

12. The method of claim 6 wherein the plurality of retainer members includes three retainer members wrapped around the terminal block and the base substrate at three respective spaced apart locations and thereby securing the sealing device to the terminal block using the at least three retainer members.

13. The method of claim 12 wherein the method includes maintaining the base substrate in a bent position using the three spaced apart retainer members.

14. The method of claim 1 wherein:

the cables are telephone wires;

the gel sealant body is applied only to the front side of the terminal block so that, in the completed installation, a rear side of the terminal block opposite the front side of the terminal block remains free of gel sealant;

the method includes securing the sealing device to the terminal block using three retainer members at three respective spaced apart locations; and the method includes maintaining the base substrate in a bent position using the three spaced apart retainer members.

15. The method of claim 1 including securing the sealing device to the terminal block using a second retainer member, wherein the second retainer member is a screw.

16. A method for environmentally protecting a terminal block, the method comprising:

providing a sealing device including:

a base substrate having an anchoring surface; and a gel sealant body having an engagement surface, wherein the gel sealant body is secured to the anchoring surface and extends forwardly from the anchoring surface to the engagement surface;

applying the sealing device to the terminal block such that the gel sealant body is interposed between the terminal block and the base substrate and the engagement surface engages the terminal block; and wrapping a retainer member around the terminal block and securing the sealing device to the terminal block using the retainer member;

wherein:

the base substrate includes a base wall and a side wall hingedly connected to the base wall, the anchoring surface being located on the base wall; and applying the sealing device to the terminal block and securing the sealing device to the terminal block includes deflecting the side wall relative to the base wall.

17. The method of claim 1 wherein the base substrate is formed of polycarbonate.

18. The method of claim 1 wherein the sealing device consists of only the base substrate and the gel sealant body.

19. A method for environmentally protecting a terminal block, the terminal block including multiple integral connectors interconnecting multiple electrical cables on a front side of the terminal block, the method comprising:

providing a sealing device including;

a base substrate having an anchoring surface; and a gel sealant body having an engagement surface, wherein the gel sealant body is secured to the anchoring surface and extends forwardly from the anchoring surface to the engagement surface;

applying the sealing device to the front side of the terminal block such that the gel sealant body is interposed between the terminal block and the base substrate and the engagement surface engages the connectors of the terminal block; and wrapping a retainer member around the terminal block and securing the sealing device to the terminal block using the retainer member;

wherein:

the base substrate includes a base wall and a side wall hingedly connected to the base wall, the anchoring surface being located on the base wall; and applying the sealing device to the terminal block and securing the sealing device to the terminal block includes deflecting the side wall relative to the base wall.

* * * * *